United States Patent [19]

Koizumi et al.

[11] Patent Number: 4,678,880

[45] Date of Patent: Jul. 7, 1987

[54] KEYBOARD SWITCH

[75] Inventors: Haruyuki Koizumi; Koichi Omae, both of Kyoto, Japan

[73] Assignee: Omron Tateisi Electronics Co., Kyoto, Japan

[21] Appl. No.: 724,308

[22] Filed: Apr. 17, 1985

[30] Foreign Application Priority Data

Apr. 18, 1984 [JP] Japan ..... 59-79119
Apr. 18, 1984 [JP] Japan ..... 59-79120
Nov. 1, 1984 [JP] Japan ..... 59-231992

[51] Int. Cl.[4] ..... H01H 3/12
[52] U.S. Cl. ..... 200/340; 200/305
[58] Field of Search ..... 200/340, 159 B, 292, 200/305

[56] References Cited

U.S. PATENT DOCUMENTS 3,769,869 11/1973 Nelson, Jr. ..... 200/305
3,780,237 12/1973 Seeger, Jr. et al. ..... 200/340
4,334,134 6/1982 Janda ..... 200/340
4,529,848 7/1985 Cherry ..... 200/159 B

FOREIGN PATENT DOCUMENTS 266970 12/1968 Austria ..... 200/340
2347278 4/1974 Fed. Rep. of Germany ..... 200/340

OTHER PUBLICATIONS

Allan, J., *Composite Switch and Cable,* IBM Tech. Disclosure Bulletin, Sep. 1984, vol. 27, No. 4B, pp. 2378–2379.

*Primary Examiner*—Stephen Marcus
*Assistant Examiner*—Renee S. Luebke
*Attorney, Agent, or Firm*—Stevens, Davis, Miller & Mosher

[57] ABSTRACT

A keyboard switch is provided which comprises a substrate on the upper surface of which a flexible switch is disposed that has paired fixed and movable contacts and includes a flexible sheet, guide posts passing through and secured to the substrate at mutually opposed positions on either side of the contacts, a key plunger fitted vertically movably in the guide posts, and a coil spring interposed between the key plunger and the substrate. The coil spring functions so that it pushes the flexible switch when compressed to cause the paired contacts to come into contact with each other and, when uncompressed, returns the key plunger to the initial position thereby to separate the paired contacts.

6 Claims, 9 Drawing Figures

KEYBOARD SWITCH

BACKGROUND OF THE INVENTION

This invention relates to a keyboard switch adapted for use in a cash register, a word processor, terminal equipment for communications, various office automation equipment, and the like.

As keyboard switches of the above type, a structure such as shown in FIG. 9, for example, is known in which a keyboard 6 is disposed on a membrane switch plate 5 with a certain spacing therebetween. This conventional keyboard switch has a poor working efficiency because of a large number of parts and a complicated structure, and is particularly thick in a transversal direction because of the coupled keyboard and switch board.

SUMMARY OF THE INVENTION

The present invention has been devised to provide a novel keyboard switch which is simplified in structure and is thin-sized through employment of a very simple configuration.

It is one object of the present invention to provide a novel keyboard switch which comprises a substrate on the upper surface of which a flexible switch is disposed that has paired fixed and movable contacts and includes a flexible sheet, guide posts passing through and secured to the substrate at mutually opposed positions on either side of the contacts, a key plunger fitted vertically movably in the guide posts, and a coil spring interposed between the key plunger and the substrate, wherein the coil spring functions so that it pushes the flexible switch when compressed to cause the paired contacts to come into contact with each other and returns the key plunger to the initial position when uncompressed to separate the paired contacts.

It is another object of the present invention to provide a keyboard switch of the foregoing structure which is characterized in that a plunger guide is composed of guide posts mutually opposing and fitted rigidly in thru-holes bored in the substrate through outsert molding and a spring seat integral with both the posts and surrounding the contact section of the flexible switch, and with the spring seat functioning so as to support the lower end of the coil spring and push and maintain the flexible switch against the substrate while surrounding the contact pair.

It is a further object of the present invention to provide a keyboard switch of the foregoing structure which further includes a ground terminal provided at an end portion of a conductive film of the flexible switch disposed on the substrate for prevention of electrification of the keyboard switch.

According to the present invention, the keyboard employed in the prior art can be eliminated; thus, the present unit can be simplified in structure and particularly, the present keyboard switch can be thin-sized. Further, by the use of the spring seat of the plunger guide the substrate and flexible switch are joined completely into a single body thereby to enhance stability of the switching action, and because the plunger guide is formed passing through the substrate from the front side to the back side the present unit can be thin-sized; thus, the present invention is very effective from a practical point of view.

According to a preferred embodiment of the present invention, the ground terminal is connected to a casing, with a key top and the conductive film being connected thereto. Therefore, static electricity from the key top is grounded through the conductive film and terminal to the casing; thus, a switch circuit and electronic parts are protected electrically. In addition, the conductive film is manufactured at low cost because it can be mass produced by aluminum vapour coating, and generation of noise is diminished because the conductive film has a large resistance and little current flows therethrough.

Other objects and advantages of the present invention will become apparent from the following detailed description of the embodiments when taken in conjunction with the accompanying drawings.

DETAILED DESCRIPTION OF THE PREFERRED EMBODIMENTS

Figure 1:
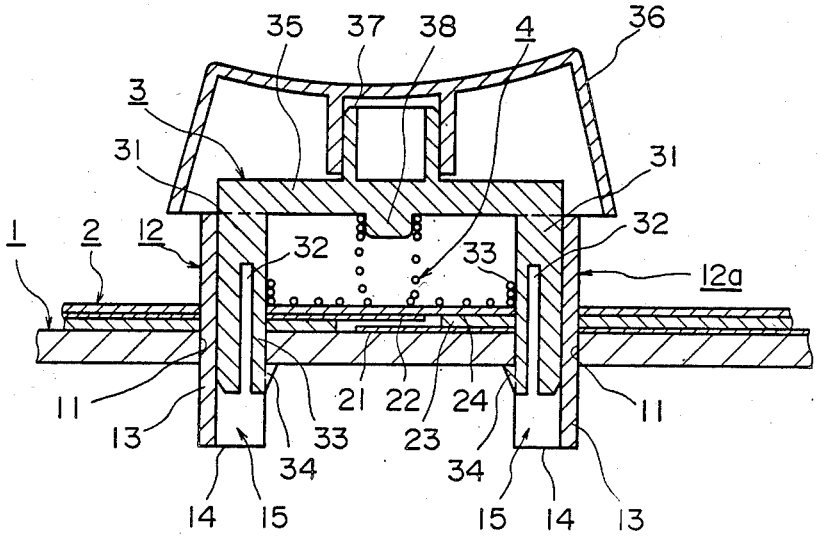
FIG. 1 is a cross sectional view of a first embodiment of a keyboard switch according to the present invention.
Figure 2:
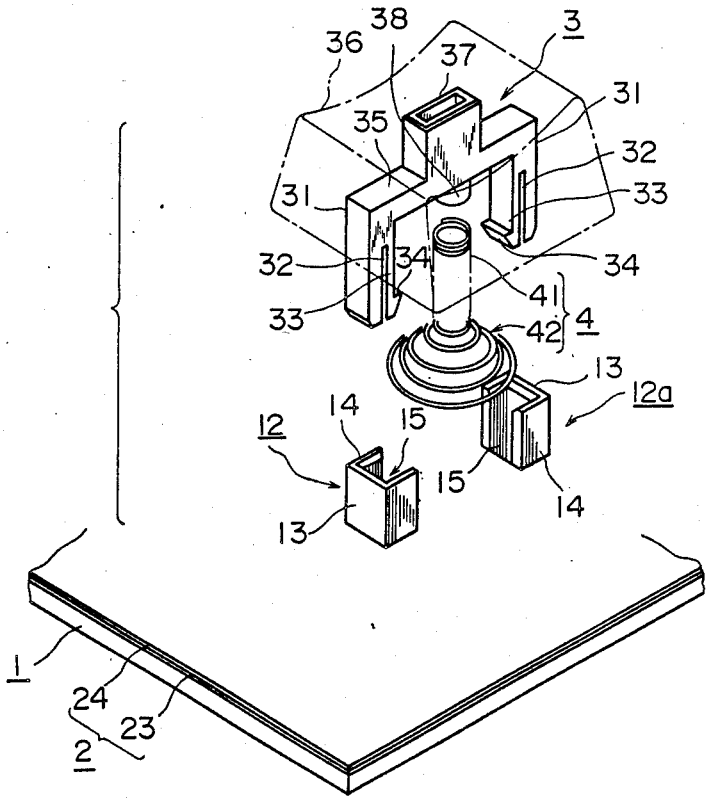
FIG. 2 is a perspective view showing an assembly process of the keyboard switch shown in FIG. 1.

A keyboard switch according to the present invention is manufactured by providing rigid guide posts 12 having a vertically-extending guide groove 15 on a substrate 1 and fitting a key plunger 3 directly in the guide posts.

The substrate 1 is a hard plate, such as synthetic resin plate, aluminum plate, iron plate, on the upper surface of which a fixed contact 21 is formed by a printed-wiring. A flexible sheet 24 formed on the under surface with a movable contact 22 which can make contact with the fixed contact and an insulation spacer 23, is superposed on the substrate 1 thereby forming a face switch 2. In the substrate 1 thru-holes 11, 11 are bored on either side of the contacts, and a pair of guide posts **12, 12*a* are fitted rigidly in the thru-holes 11, 11. These guide posts 12, 12*a* are formed by injection molding or direct outsert molding on the substrate 1** by the use of lubricative synthetic resin such as nylon.

Figure 8:
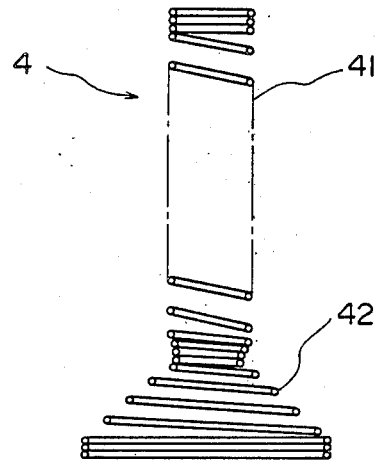
FIG. 8 is a front view of a coil spring.
Figure 9:
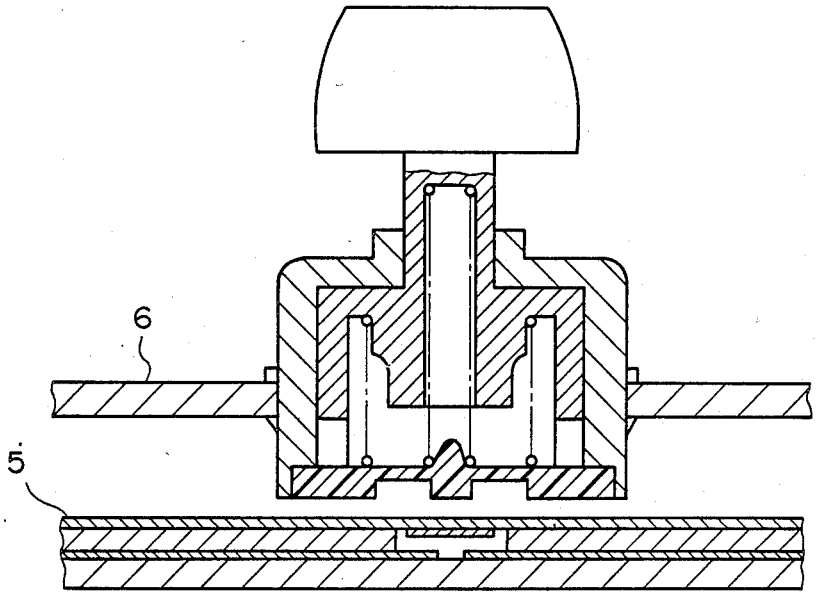
FIG. 9 (PRIOR ART)
FIG. 9 is a cross sectional view of the conventional keyboard switch.

Each of the guide posts **12, 12*a* has mutually opposed side walls 14, 14 joined on either edge of an outer wall 13 and a guide groove 15 passing vertically and opening on the side of an inner face. The key plunger 3 is fitted vertically movably in the guide grooves 15, 15. The key plunger 3 is a molding made of lubricative synthetic resin, similarly to the guide posts, and is made in the form of an arch such as to be movable vertically with respect to the guide grooves 15, 15. Each of mutually opposed leg portions 31, 31 of the key plunger 3 is formed with a leg segment 33 which is made elastic by a split groove 32 and a pawl segment 34 which is formed at the end of the elastic leg segment 33 and locked by an inner edge portion around the thru-hole 11 of the under face so that the upper limit of vertical movement is controlled. In the center of a connection portion between these leg portions 31, 31 there are formed a mounting shaft 37 for a key top 36 on the upper side and a spring holding shaft 38 on the under side, with a coil spring 4 interposed between the holding shaft 38 and a portion of the substrate 1 corresponding to the former. As shown in FIG. 8, the coil spring 4 is made up of a switch pushing spring portion 41 in the form of a spiral of regular pitch and a continued spring portion 42** for returning the key plunger upward, the diameter of each coil of the latter portion increasing progressively like a cone.

The coil spring 4 surrounds the contacts 21, 22, is disposed between the upper surface of the flexible sheet 24 and the holding shaft 38 of the key plunger 3, and urges the key plunger upward. In place of the spring 4 included in the illustrated embodiment, the present invention can use two springs so interposed as above: one for pushing the switch and the other for returning the plunger.

Figure 3:
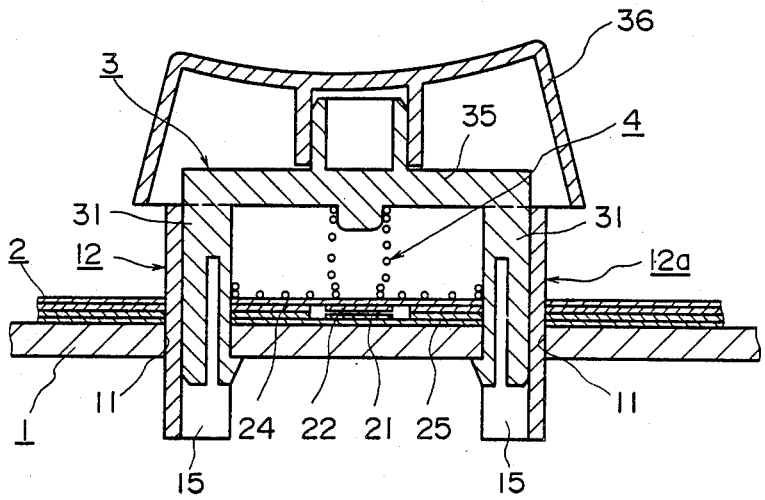
FIGS. 3 through 6 are cross sectional views of other embodiments of the keyboard switch according to the present invention.

In a second embodiment shown in FIG. 3, in order to form the flexible switch 2, two flexible sheets 24, 25 having paired contacts 21, 22 in the form of a printed-wiring are superposed on the substrate 1 which is provided rigidly with the guide posts 12, 12*a* similarly to the first embodiment. In this second embodiment, on the under surface of one flexible sheet 24 the insulation spacer 23 is laminated except for a portion around the movable contact 22, whereby a switching gap is left between the paired contacts 21, 22.

Figure 4:
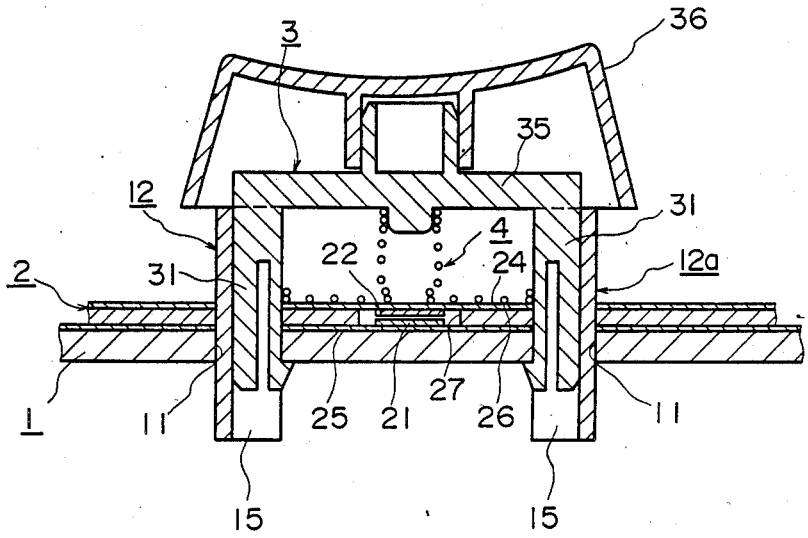
Figure 5:
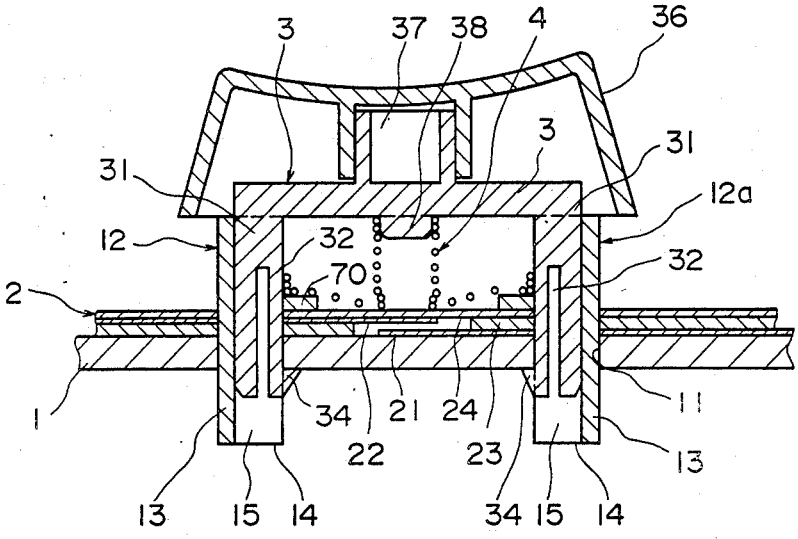

In a third embodiment shown in FIG. 4, a sheet 26 serving as the insulation spacer is interposed between the two flexible sheets 24, 25. In the sheet 26 a thru-hole 27 is bored at a position corresponding to the contacts 21, 22.

Although not shown in the drawing, it is possible to use a silicone rubber sheet as the flexible sheet 24 providing the movable contact. In this case, insulation is realized by denting a portion around the contact like a bowl.

In a fourth embodiment shown in FIG. 4, the key plunger 3 is fitted vertically movably between the guide posts 12, 12*a*, which has a ring-like spring seat 70 provided integrally with the posts 13 so that the spring seat 70 surrounds the contacts 21, 22.

The coil spring 4 is interposed between the spring seat 70 and the holding shaft 38 of the key plunger 3 and urges the key plunger upward.

Figure 6:
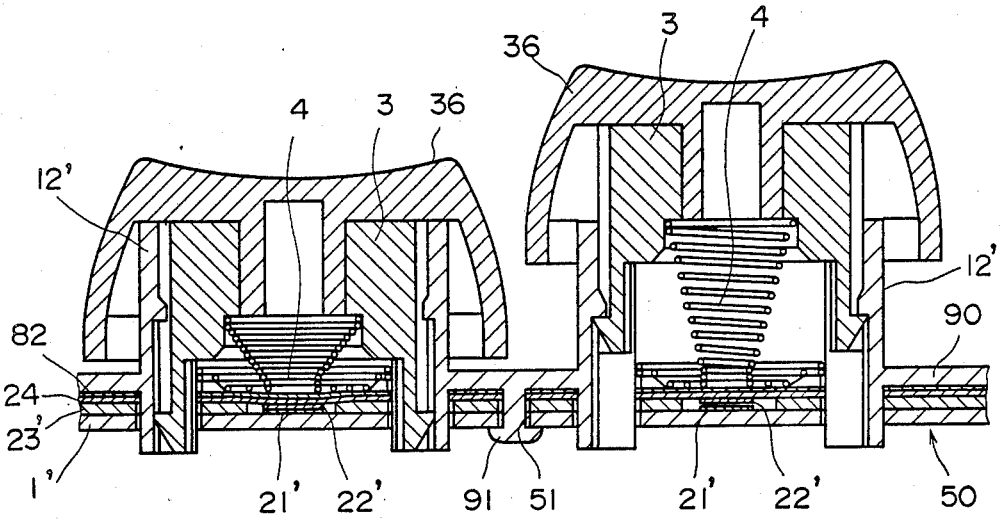
Figure 7:
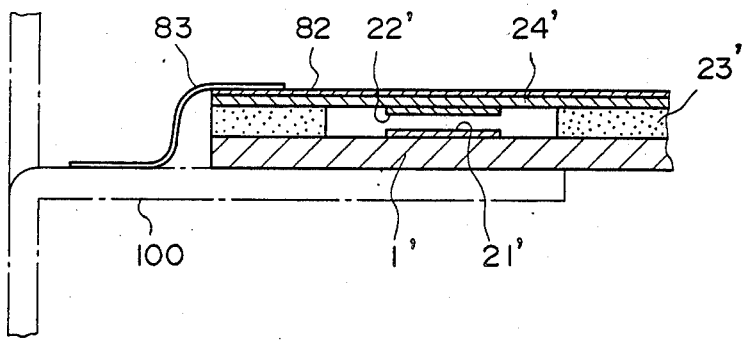
FIG. 7 is a cross sectional view showing an earth connection portion of the keyboard switch shown in FIG. 6.

A keyboard forming keyboard switches of a fifth embodiment shown in FIGS. 6 and 7 is a molding made of synthetic resin, whose cover plate 90 has a number of cylindrical plunger guides 12' formed integrally therewith, in individual guides 12' each key plunger 3 being fitted vertically movably. In each guide 12' the spring 4 is disposed for returning the plunger 3 upward and pushing the switch. In assembly, a switch section 50 according to the present invention is disposed and joined to the under surface of the cover plate 90, a fixing shaft 91 projecting from the cover plate 90 is made to pass through a fixing hole 51 bored at an appropriate position in the switch section 50, and the head of the fixing shaft is calked and fixed by heating.

The switch section 50 in which the characterizing feature of the present invention is embodied is produced by superposing, on a print-circuit substrate 1' formed on the upper surface with a conductive pattern 21', an insulation spacer 23' and a flexible membrane sheet 24' formed on the under surface with a conductive pattern 22' which makes a pair with the foregoing conductive pattern 21'. On the upper surface of the membrane sheet 24' a conductive film 82 is formed integrally by aluminum vapour coating and the like, the end of a film-like ground terminal 83 is pressed under heating onto an end portion of the conductive film 82, and the point of the ground terminal 83 is connected to a metallic casing 100.

Although in the embodiment shown in FIGS. 6 and 7 the plunger guides 12' are formed integrally on the cover plate 90, it is of course possible to attach the plunger guides 12' rigidly to the substrate 1'.

What is claimed is:

1. A keyboard switch comprising:

a substrate having on an upper surface thereof a flexible switch which has a pair of spaced engageable contacts, at least one of said contacts being fixed to a flexible sheet, at least two guide posts passing through respective apertures in said substrate and being secured to said substrate at mutually opposed positions on either side of said contacts, a key plunger having spaced extending leg portions respectively fitted vertically movably in said guide posts, said key plunger being capable of reciprocal up and down movement with said leg portions being guided by said guide posts and moving through said substrate during said reciprocal movement, and a coil spring interposed between said key plunger and said substrate, said coil spring pushing said flexible switch, when compressed by a depression of said plunger, to cause said paired contacts to come into contact with each other and, when uncompressed, returning said key plunger to an initial position to separate said paired contacts.

2. A keyboard switch as set forth in claim 1, wherein said key plunger has a pawl segment abutting on the under surface of said substrate, each said pawl segment being formed at the end of an elastic leg segment which is separated by a split groove from an associated plunger leg portion.

3. A keyboard switch as set forth in claim 1, further comprising a ground terminal formed as a filmlike member provided at an end portion of a conductive film of said flexible switch disposed on said substrate.

4. A keyboard switch as set forth in claim 1, wherein said guide posts are fitted rigidly in the aperture of said substrate through outsert molding, and said keyboard switch further comprises a spring seat integral with both said posts and surrounding said contact pair of said flexible switch, said spring seat supporting a lower end of said coil spring and maintaining said flexible switch against said substrate while surrounding said contact pair.

5. A keyboard switch as set forth in claim 4, wherein said contacts are formed by a printed-wiring on the upper surface of said substrte and on an under surface of said flexible sheet, respectively.

6. A keyboard switch as set forth in claim 4, wherein said contacts are formed on respective flexible sheets by a printed-wiring.

* * * * *